US009588464B2

(12) United States Patent
Deprez et al.

(10) Patent No.: US 9,588,464 B2
(45) Date of Patent: Mar. 7, 2017

(54) DIGITAL PRINTING APPARATUS AND PRINTING PROCESS

(71) Applicant: Xeikon IP B.V., Eede (NL)

(72) Inventors: Lode Erik Dries Deprez, Wachtebeke (BE); Nick Horemans, Noorderwijk (BE)

(73) Assignee: Xeikon IP B.V., Eede (NL)

( * ) Notice: Subject to any disclaimer, the term of this patent is extended or adjusted under 35 U.S.C. 154(b) by 0 days.

(21) Appl. No.: 14/392,166

(22) PCT Filed: Jun. 27, 2014

(86) PCT No.: PCT/NL2014/050425
§ 371 (c)(1),
(2) Date: Dec. 23, 2015

(87) PCT Pub. No.: WO2014/209123
PCT Pub. Date: Dec. 31, 2014

(65) Prior Publication Data

US 2016/0179035 A1 Jun. 23, 2016

(30) Foreign Application Priority Data

Jun. 28, 2013 (NL) ..... 2011067
Mar. 28, 2014 (NL) ..... 2012525

(51) Int. Cl.
*G03G 15/10* (2006.01)
*G03G 15/11* (2006.01)
(Continued)

(52) U.S. Cl.
CPC ..... *G03G 15/11* (2013.01); *G03G 15/161* (2013.01); *G03G 15/162* (2013.01); *G03G 15/169* (2013.01); *G03G 15/657* (2013.01)

(58) Field of Classification Search
CPC .... G03G 15/11; G03G 15/161; G03G 15/162; G03G 15/169
(Continued)

(56) References Cited

U.S. PATENT DOCUMENTS 3,715,225 A * 2/1973 Day ..... G03G 15/2007 355/29
4,897,691 A * 1/1990 Dyer ..... G03G 15/2003 219/216
(Continued)

FOREIGN PATENT DOCUMENTS

EP 0244198 A2 11/1987
JP 63303382 A 12/1988
(Continued)

*Primary Examiner* — Hoang Ngo
(74) *Attorney, Agent, or Firm* — The Webb Law Firm

(57) ABSTRACT

The digital printing apparatus uses a liquid toner comprising toner particles in a carrier liquid for printing an image on a substrate. It includes an imaging member adapted to sustain a pattern of electric charge forming a latent image on its surface; a development member arranged to receive a quantity of the liquid toner dispersion and to develop said latent image; means for transfer of the liquid toner dispersion from the imaging member to the substrate at a transfer location, and a fusing unit. The apparatus further includes a liquid removal unit arranged for removal of carrier liquid from the substrate, and upstream of said fusing unit.

19 Claims, 4 Drawing Sheets

(51) Int. Cl.
*G03G 15/16* (2006.01)
*G03G 15/00* (2006.01)

(58) Field of Classification Search
USPC ..... 399/249, 328, 336
See application file for complete search history.

(56) References Cited

U.S. PATENT DOCUMENTS

| | | | |
|---|---|---|---|
| 4,985,733 | A | 1/1991 | Kurotori et al. |
| 5,493,369 | A | 2/1996 | Sypula et al. |
| 6,148,169 | A | 11/2000 | Tsukamoto |
| 2011/0249990 | A1 | 10/2011 | Izawa et al. |
| 2015/0168863 | A1 | 6/2015 | Op de Beeck et al. |
| 2015/0198903 | A1 | 7/2015 | Deroover et al. |
| 2015/0205221 | A1 | 7/2015 | Deroover et al. |

FOREIGN PATENT DOCUMENTS

| | | | |
|---|---|---|---|
| JP | 2009163065 | A | 7/2009 |
| JP | 2009282280 | A | 12/2009 |
| NL | 2010807 | C | 12/2014 |
| NL | 2011064 | C | 1/2015 |
| NL | 2011067 | C | 1/2015 |
| NL | 2011955 | C | 6/2015 |
| NL | 2012086 | C | 7/2015 |
| NL | 2012115 | C | 7/2015 |

* cited by examiner

DIGITAL PRINTING APPARATUS AND PRINTING PROCESS

CROSS-REFERENCE TO RELATED APPLICATIONS

This application is the United States national phase of International Application No. PCT/NL2014/050425 filed Jun. 27, 2014, and claims priority to The Netherlands Patent Application Nos. 2011067 and 2012525 filed Jun. 28, 2013 and Mar. 28, 2014, respectively, the disclosures of which are hereby incorporated in their entirety by reference.

FIELD OF THE INVENTION

The invention relates to a digital printing apparatus using a liquid toner comprising toner particles in a carrier liquid for printing an image on a substrate, which apparatus comprises:

- a development member arranged to receive a quantity of the liquid toner and provided with means for charging said liquid toner
- an imaging member arranged in contact with said development member so as to receive the charged liquid toner under the impact of an electric field from the development member according to a pattern of electric charge forming a latent image on the imaging member
- means for transfer of the liquid toner from the imaging member to the substrate at a transfer location, and
- a fusing unit for contact fusing of the liquid toner into the image on the substrate using heated rollers.

The invention further relates to a digital printing process comprising the steps of applying the said liquid toner dispersion on the development member, charging said liquid toner dispersion, transferring the charged liquid toner dispersion patternwise to the imaging member and thereafter to a substrate, and contact fusing the toner dispersion into the image.

BACKGROUND OF THE INVENTION

Digital printing apparatus using liquid toner dispersion—also known as liquid toner—are known from U.S. patent application publication no. 2011/0249990. The known digital printing apparatus comprises a feed member, a development member, development member cleaning means, and an image carrying member, these member being preferably rollers; the feed member being arranged to transfer a quantity of liquid toner from a toner container onto the toner member; and the development member being arranged to transfer a portion of the quantity of liquid toner onto the image carrying member in accordance with a charge pattern sustained on a surface of said image carrying member. A liquid toner residue, also referred to as an excess liquid toner, remains on (the surface of) the development member after the imagewise transfer of the liquid toner from the development member to a further member, particularly the imaging member.

After transfer to the imaging member, the liquid toner dispersion is transferred to the substrate, either directly or via a further member. This transfer process is carried out for each colour separately. The liquid toner dispersion is subsequently fused in a fusing unit, resulting in a film according to a desired pattern, and hence an image on the substrate. Fusing may be carried out in various manners and typically involves heating.

Fusing of the liquid toner is one of the sensitive steps in the digital printing process. This fusing is to result in coalescence of the toner particles on the substrate. The term 'coalescence' refers herein to the process wherein toner particles melt together and form a film or continuous phase that adheres well to the substrate and that is separated from any carrier liquid. The fusing has to avoid formation of an emulsion, since an emulsion does not give a good printing image.

A particular issue resulting in misprints, is known as ghost fusing images. These are images that are different in colours and/or portions of the image being slightly shifted in gloss. It is necessary for high quality printing to prevent such ghost images, without reducing of printing speed of the digital printing apparatus, i.e. a high-speed of the substrate moving through the printing apparatus, for instance of at least 50 cm/s, preferably at least 70 cm/s or even at least 1 m/s.

SUMMARY OF THE INVENTION

It is therefore an object of the invention to provide an apparatus and a process which are less susceptible of generating ghost fusing images.

According to a first aspect, the invention relates to a digital printing apparatus using a liquid toner comprising toner particles in a carrier liquid for printing an image on a substrate, which apparatus comprises (1) a development member arranged to receive a quantity of the liquid toner and provided with means for charging said liquid toner; (2) an imaging member arranged in contact with said development member so as to receive the charged liquid toner under the impact of an electric field from the development member according to a pattern of electric charge forming a latent image on the imaging member; (3) means for transfer of the liquid toner from the imaging member to the substrate at a transfer location, and (4) a contact fusing unit for contact fusing of the liquid toner into the image on the substrate using heated rollers. The apparatus further comprises a film formation unit for operating on the portion of the liquid toner transferred from the imaging member to the substrate, said film formation unit being configured to transform said toner particles of the liquid toner into a film, i.e. to coalescence the toner particles. The contact fusing unit is arranged downstream of the film formation unit. The apparatus further comprises at least one liquid removal unit for removal of carrier liquid from the substrate subsequent to transfer of the developed toner to the substrate.

According to a second aspect, the invention provides a process of digitally printing an image on a substrate, comprising the steps of

- applying liquid toner comprising toner particles in a carrier liquid on a development member charging said liquid toner, said liquid toner further comprising a dispersing agent for stabilising the toner particles in the carrier liquid, which toner particles comprise pigment and a binder resin;
- transferring the liquid toner to an imaging member arranged in contact with said development member under the impact of an electric field according to a pattern of electric charge forming a latent image on the imaging member;
- transferring the liquid toner from the imaging member to the substrate at a transfer location,
- forming a film of the liquid toner subsequently to the transfer to the substrate,
- removing carrier liquid from the liquid toner transferred to the substrate, and fusing the liquid toner film into the image on the substrate by means of contact fusing using heated rollers.

The present invention provides an improved transformation process for the liquid toner dispersion on the substrate. This transformation process is efficient, substantially prevents wrinkling of the substrate and prevents ghost fusing images. This transformation process comprises film formation and liquid removal prior to the actual contact fusing. The contact fusing thereafter is carried out to improve the adhesion of the toner film to the substrate to a desired level and to adjust gloss. Surprisingly, it was found in preliminary experiments with the printing apparatus and process of the invention that images may be printed in very high coverage (for instance up to 400% (=100% coverage for each of the Cyan, Magenta, Yellow and Black colours) without adjusting an amount of heat applied in the transformation process and without adjustment of printer speed.

The liquid removal unit is particularly a mechanical unit and is configured to remove carrier liquid while the liquid toner is present on the substrate without significant evaporation of carrier liquid. Such liquid removal unit is particularly suitable for a digital printing process, wherein a plurality of layers of liquid toner is present on the substrate, and especially on top of each other. The volume of liquid that is liberated during coalescence can be significant. Artefacts may appear, such as the formation of an insulating layer, which reduces heat transfer during contact fusing, and which may result in ghost images. Therefore, in accordance with the invention, carrier liquid is removed prior to contact fusing, but after transfer to the substrate, since the system still requires a large enough amount of carrier liquid to guarantee a good electrophoretic transfer from the roller to the substrate prior to the fusing.

According to a first embodiment, the film formation unit comprises means for non-contact coalescence. Such means are more specifically a source of infrared radiation. Preferably use is made of a source of infrared radiation in the near-infrared range (NIR), such as with a wavelength of up to 2000 nm. It was found that such sources can be operated fast enough so as to enable a high-speed process. One type of suitable infrared sources is carbon lamps.

In one preferred embodiment, the removal unit are embodied as a removal member that is in use in rotational contact with at least an outer layer of the liquid toner dispersion, as transferred to the substrate. The use of such a removal member has been found to allow liquid removal at a sufficiently high flow rate, so as not to disturb the printing. Such a removal member is particularly a roller. It may be porous or non-porous. Particularly when porous, it may be beneficial to integrate a channel into the roller, through which the carrier liquid may be removed from the roller. Alternatively, liquid may be removed from a surface of the roller.

In one embodiment, the liquid removal unit comprises a sponge member and a pressure member respectively arranged for rotating at either side of the substrate. The sponge member is arranged to face the side of the substrate carrying the portion of liquid toner. Preferably, the sponge member has an outer layer adapted to absorb carrier liquid, such that said sponge member absorbs carrier liquid whilst rotating over the portion of liquid toner.

In further implementations, the outer layer of the sponge member may be configured for absorbing carrier liquid whilst keeping particles having a size above a critical size at the outer surface. The critical size is typically below 200 nm, and preferably lies in a range between 5 nm and 200 nm, e.g. in a range between 20 nm and 200 nm. In a possible embodiment, the outer layer is adapted for absorbing the carrier liquid by capillary action.

According to another implementation, the outer layer may comprises a semi-permeable membrane adapted for being semi-permeable vis-á-vis the carrier liquid, while blocking the toner particles. When a semi-permeable membrane is used, the removal means could be e.g. a number of suction channels arranged in the sponge member for removing the carrier liquid that has permeated through the semi-permeable membrane. According to again another implementation, the carrier liquid removal unit may comprise suction means without the provision of a barrier for the toner particles. Such embodiments will be possible if the toner particles adhere well to the substrate so that there is substantially no risk that the particles are removed with the carrier liquid.

More preferably, the liquid removal unit is configured for applying an electric field so as to push charged toner particles in the liquid toner away from the roller surface to the surface of the substrate. Thereto, it is deemed beneficial, in one implementation, that the removal member comprises an electrically conductive material to which a voltage may be applied. The electrically conductive material is suitably a metal. It will therefore be understood that the removal member is suitably based on metal, but that it also may contain non-metal parts and/or layers and coatings like a conductive rubber roller. The applied voltage will be such that the charged elements in the liquid toner are moved towards the substrate surface and hence away from the rotational member. Thereto, it is suitable that a support member is present at the opposed side of the substrate, which support member is held at another potential, for instance ground.

The applied voltage is particularly chosen such that layer splitting occurs. The splitting will occur between a first layer rich in toner particles adjacent to the substrate surface and an outer layer primarily consisting of carrier liquid. It will be understood that the first layer and the outer layer may gradually change over, or that an intermediate layer would be formed in between of the outer layer and the first layer.

The applied voltage will depend on the exact composition of the liquid toner, and the amount of charging applied thereto. Typically, the charge is fixed within the liquid toner dispersion on the dispersing agent and optional other agents. Neither the carrier liquid, nor the binder resin is easily charged. In one suitable embodiment, the liquid toner dispersion further comprises a spacer agent, with the function to space individual toner particles and individual dispersing agents apart. Agglomeration of toner particles will hide charged groups and therefore decrease the susceptibility of the particles for the electrical field. Typically the applied voltage at the removal location will be higher than any voltage difference present at the imaging member. Spacer agents suitable for liquid toner dispersions are described in the non-prepublished applications NL2010807 and NL2012115, which are included herein by reference.

In one embodiment, the applied voltage difference in the liquid removal location is higher than a voltage difference present at the imaging member. Typically, the imaging member may have such voltage to define a latent image in electrical manner, however without any intention or effect of layer splitting.

In order to optimize the process, and suitably reduce the voltage to be applied, the liquid toner dispersion may be subjected to a further charging treatment after its transfer to the substrate and prior to the liquid removal. Thereto, in a preferred embodiment, a charging unit, such as a corona treatment device, is arranged downstream of the transfer location and upstream of the liquid removal location. If desired, a further discharging treatment could be applied between the liquid removal and the fusing.

The liquid removal at the removal location is preferably combined with a non-contact type of fusing or coalescence, for which appropriate means will be present, for instance near or far infrared irradiation and/or hot air flow. Such non-contact type fusing has the advantage of minimizing the risk of distorting the image onto the substrate since the first step of the fusing takes place without the toner image being present in an electric field.

In one embodiment, the non-contact type fusing is preceded by the liquid removal on the substrate. This increases the efficiency of the non-contact coalescence that any non-contact fusing may be carried out in an efficient manner. Moreover, because of the combination of liquid removal and non-contact coalescence, the heat requirement of this coalescence step will be somewhat reduced, as less carrier liquid is present.

In another embodiment, the non-contact type fusing precedes the liquid removal. This order has the advantage that the liquid removal may be highly efficient. The infrared irradiation will induce film formation so that no electric field may be needed for the layer removal. Moreover, this order increases the time between the irradiation step and the contact fusing (in comparison to the other alternative or no liquid removal at all). That allows that the film formation may have longer duration, i.e. that the dispersing agent is further dissolved into the binder resin and particles have further fused at the start of the contact fusing. Furthermore, and not unimportantly, it has been observed that the film formation upon IR irradiation results in liberation of any carrier liquid hidden or dispersed around the toner particles. Carrying out any liquid removal step subsequent to the IR irradiation thus enables removal of this liberated carrier liquid.

One important advantage of carrier liquid removal is that this carrier liquid may be recycled and reused within the machine.

In a further implementation of this preferable embodiment, a first carrier liquid removal unit is provided upstream of the means for non-contact coalescence and a second carrier liquid removal unit is provided downstream of said means for non-contact coalescence but upstream of the means for contact-fusing. The order of steps is then a first carrier liquid removal step, a non-contact coalescence step, a second carrier liquid removal step and a contact fusing step. This implementation further reduces the possibility of ghost fusing to occur.

Suitably, a plurality of imaging stages is present, each imaging state comprising a development member and imaging member and transfer means and being configured for transfer of liquid toner dispersion according to a predefined pattern to the substrate.

According to a first, preferred implementation, a first and a second imaging stage and the liquid removal unit are arranged such that liquid is removed from the liquid toner dispersions of the first and the second imaging stages at a first removal location. According to this implementation, the number of removal unit and removal locations is smaller than the number of imaging stages. In one embodiment, the apparatus comprises merely one liquid removal location. This is beneficial for simplicity of design, and could be used when the number of imaging stages is relatively low, for instance at most four. In an alternative embodiment, the number of imaging stages per liquid removal location is typically two or three. It is however not excluded that for specific imaging stages, which require a large amount of carrier liquid a separate imaging stage would be present. The amount of carrier liquid removal stations can also be dependent upon the nature of the substrate and in case of a very absorbing substrate the carrier liquid removal devices on the substrate can be disabled.

According to a second implementation, a first and a second imaging stage and the liquid removal unit are arranged such, that liquid is removed from the liquid toner dispersion of the first imaging stage at a first removal location located downstream of the transfer location of the first imaging stage and upstream of the transfer location of the second imaging stage, and that liquid is removed from the liquid toner dispersion of the second imaging stage at a second removal location downstream of said transfer location of the second imaging stage. This second implementation has the advantage that the carrier liquid is removed quickly after the transfer to the substrate. This reduces the risk for damage of the substrate or changes in transparency of the substrate due to the impregnation of the substrate with carrier liquid.

Arrangements and implementations for the imaging stages are in itself known to the skilled person. Suitably, the development member is provided with a carrier liquid displacement device, which is placed upstream of an interface with the imaging member, in a position adjacent to the development member, and is configured to create a spatial separation of the toner particles and the carrier liquid within the toner, whereby the carrier liquid is displaced to the surface of the toner layer, to supply or adjust the charge on the individual toner particles. Such a carrier liquid displacement device is deemed suitable to arrange the transfer from the development member to the imaging member. Preferably, such carrier liquid displacement device is embodied as a corona generating device.

In one embodiment, an additional transfer member may be present between the imaging member and the substrate, so as to remove carrier liquid. The transfer member of this embodiment is suitably a porous member, suitable for adsorption of liquid into the interior of the transfer member and to keep the toner particles at the surface of the transfer member. This transfer member is further described in the non-prepublished application NL2011067, which is herein included by reference.

In another embodiment, use is made of a liquid toner dispersion comprising a decomposable dispersing agent, such as described in the non-prepublished patent application NL2011064 in the name of Applicant, which is herein included by reference. Such a decomposable dispersing agent preferably comprises an anchoring group, a stimulus responsive part and a stabilizing part. By performing the decomposition before the carrier liquid removal takes place, more carrier liquid can be removed resulting in a better coalescence and better fusing performance.

The present printing apparatus and the printing process are particularly suitable in combination with liquid toners with a carrier liquid that is substantially non-evaporative, i.e. which do not substantially evaporate at any temperature residing in the course of the printing process. This choice has the advantage that the mechanical removal is typically faster than evaporation. Moreover, the risk of failure of the apparatus due to contamination as a consequence of vaporized and elsewhere condensed carrier liquid is reduced. Furthermore, the carrier liquid may be recycled.

The carrier liquid is more particularly a transparent oil and suitably without any volatile organic carbohydrates (VOCs) and preferably aromatic free or from vegetable origin. Also in the light to avoid any evaporation, fusing temperatures are suitably held relatively low, for instance less than 120-130° C., in contrast to prior art wherein fusing temperatures may well be 140-180° C., such as in the liquid toner process disclosed in Japanese patent publication 63-303382.

More preferably, use is made of toner particles with an average diameter of less than 2.5 μm, such as 1.5-2.0 μm. Preferably, the particles are ellipsoid in shape. Such toner particles may be obtained using suitable milling steps, for instance with a polyester binder. It is further preferable that the dispersing agent is a so-called hyperdispersing agent, comprising an anchoring part with a plurality of anchoring sites for adsorption to the toner particle's surface and a plurality of stabilizing parts extending into the carrier liquid.

It is added for sake of clarity that the average particle size and particle size distribution as specified are obtained by using the technique of laser diffraction to measure the size of particles. More specifically, the measurement is carried out by measuring the intensity of light scattered as a laser beam passes through a dispersed particulate sample. This data is then analysed to calculate the size of the particles that created the scattering pattern. A measurement apparatus herein is commercially available and for instance from Malvern as a Mastersizer.

Preferably, the digital printing process is carried out in a manner, wherein the concentration of toner particles has already been increased before transfer of the liquid toner dispersion to the substrate. Suitably at least 30% of the carrier liquid is removed before said transfer to the substrate. This amount may depend on the image density. Preferably, even 40-50% of the carrier liquid is removed before said transfer. Above this limit electrostatic transfer problems may occur during this transfer. The amount of carrier liquid removed prior to the transfer to the substrate clearly also depends on the starting concentration of toner particles in the liquid toner dispersion. Preferably, use is made of an initial concentration in the order of 15-45%, such as 20-30% by weight.

INTRODUCTION OF THE FIGURES

These and other aspects of the invention will be further elucidated with reference to the figures, which are diagrammatical in nature and not drawn to scale and wherein:

FIG. 3 illustrates schematically a further embodiment of a transfer member of the invention, and.

DETAILED DISCUSSION OF ILLUSTRATED EMBODIMENTS

Figure 1:
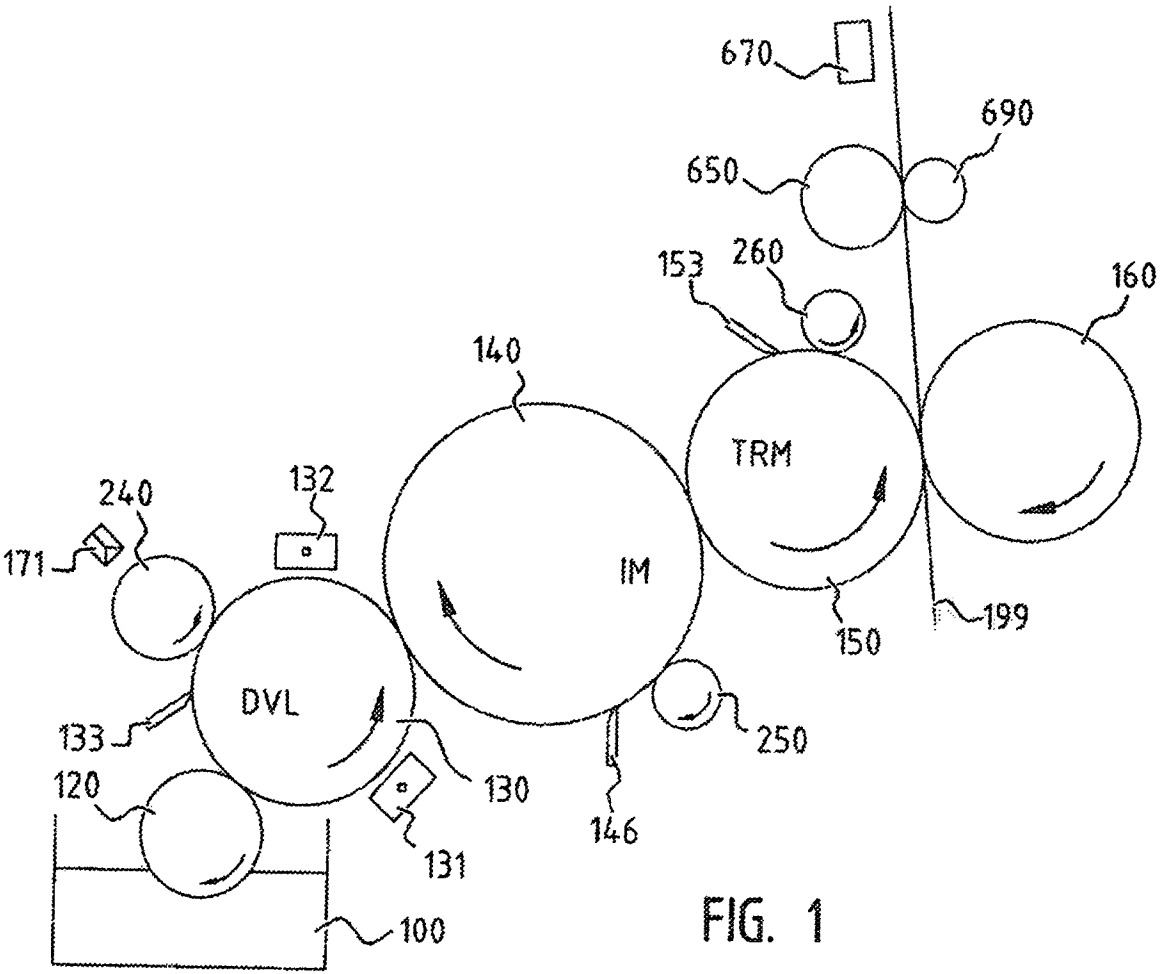
FIG. 1 is a schematic view illustrating a first embodiment of the invention.

The Figures are not drawn to scale and purely diagrammatical in nature. Equal reference numerals in different Figures refer to equal or corresponding features.

FIG. 1 illustrates diagrammatically a first embodiment of a digital printing apparatus of the invention, comprising a reservoir 100, a feed member 120, a toner member 130, an imaging member 140, a intermediate member 150 and a support member 160. A substrate 199 is transported between intermediate member 150 and support member 160. Both the development member 130 and the imaging member 140 and also the intermediate member 150 can function as the first member according to the invention, and are shown to be provided with a removal device 133, 146, 153, and with treatment means 132, 240, 250, 260. Without loss of generality, the aforementioned members are illustrated and described as rollers, but the skilled person understands that they can be implemented differently, e.g. as belts.

In operation, an amount of liquid toner dispersion, initially stored in a liquid toner dispersion reservoir 100, also called main reservoir, is applied via a feed member 120, to a development member 130, an imaging member 140, and an optional intermediate member 150, and finally to a substrate 199. The development member 130, imaging member 140, and intermediate member 150 all transfer part of the liquid toner dispersion 100 adhering to their surface to their successor; the part of the liquid toner dispersion 100 that remains present on the member's surface, i.e. the excess liquid toner dispersion, which remains after selective, imagewise transfer, is removed after the transfer stage by appropriate means. The development member 130, the imaging member 140 and the intermediate member 150 may all act as the first member.

The charging of the toner on the development roll is done by charging device 131. This charging device can be a corona or a biased roll. By charging the toner the liquid toner dispersion splits into an inner layer at the surface adjacent of the development member 130 and an outer layer. The inner layer is more rich is toner particles and the outer layer is richer in carrier liquid. The transition between these two layers may be gradual.

Upon transfer of the liquid toner dispersion from the development member 130 to the imaging member 140, excess liquid toner dispersion is left on the development member 130. Ideally, this excess liquid toner dispersion is present only in "non-image" areas, i.e. areas not corresponding to the image to be printed on the substrate, which is specified by the imaging member. However, it is not excluded that a thin layer remains on the development roller 130 at the area of the transferred image.

FIG. 1 further shows a discharging corona 132 that is provided downstream of the area of the rotational contact between the toner roller 130 and the imaging roller 140. The discharging corona 132 is suitable for changing/removing the charge in the dispersion. Further, downstream of the discharge corona 132 there is provided an additional member 240. In this example, the additional member is embodied as a loosening roller, which is provided with a rubbing portion. This is useful for improvement of mixing of the excess liquid toner dispersion with the added spacer agent. Similar loosening rollers 250, 260, which could be simply addition rollers without a dedicated rubbing portion, are present in rotational contact with the imaging member 140 and the intermediate member 150 respectively. Thereafter, a removal device is present, which most suitably is a scraper 133. The removed material is preferably recycled into fresh liquid toner.

A sensitive step in the printing process is the fusing of the liquid toner. This fusing is to result in coalescence of the toner particles on the paper. Typically use is made of a heat treatment that takes place shortly before, during or more preferably shortly after the transfer of the dispersion to the substrate. The term 'coalescence' refers herein to the process wherein toner particles melt and form a film or continuous phase that adheres well to the substrate and that is separated from any carrier liquid. Suitably, the carrier liquid is thereafter removed in a separate step, for instance by means of rollers, by means of blowing off the carrier liquid, by means of suction. Suitably, this process occurs at "high speed", for instance 50 cm/s or more, so as to enable high-speed printing. During the fusing it is necessary to avoid formation of an emulsion, since an emulsion does not give a good printing image because film formation is omitted. The presence of the spacer agent(s) does not or not significantly interfere with this filming behaviour at elevated temperature.

According to the invention, use is made of a liquid removal unit 650 that removes liquid from the substrate 199. The liquid removal unit 650 is suitably embodied as a member that is in rotational contact with the substrate, or at least with an outer layer of the liquid toner dispersion transferred to the substrate. It is deemed suitable to provide a counter-member 690 at the opposed side of the substrate 199. The liquid removal unit 650 is particularly provided upstream of a fusing unit 670. In this manner formation of a ghost fusing image is prevented, which is believed to be due thereto, that too much carrier liquid is available in the liquid toner dispersion during fusing, especially when a plurality of liquid toner dispersions—transferred from separate imaging stages—are present on top of each other on the substrate 199. The inventors have observed that, in order to avoid ghost fusing patterns, removing the carrier liquid before non-contact fusing is much more adequate than removing the carrier liquid during contact-fusing, i.e. by means of hot rollers. Moreover, the amount of liquid to be removed may be controlled in dependence of the substrate type.

It is acknowledged that U.S. Pat. No. 4,985,733 discloses a digital printing process using liquid toner that is suitable for less- or non-absorbing substrates, such as transparent (polymer) films for overhead projectors and art paper. The patent proposes the use of a liquid removal unit after the transfer to the substrate, so as to remove excessive carrier liquid, and to bring the solvent retention ratio down to 65%. This patent makes use of a toner with a carrier liquid that is evaporated during the fusing at 140° C. Therefore, it is apparent that the liquid removal unit does not result in film formation.

In a preferred embodiment, use is made of a liquid removal unit 650 comprising means for applying a voltage difference over the liquid toner dispersion. This means are suitably embodied as an electrical conductor coupled to any voltage source. The counter-member 690 herein constitutes the counter electrode. The voltage is herein applied in such a manner that the charged toner particles are pushed to the substrate 199, such that carrier liquid and toner particles are split up between a first and a second layer. The second, outer layer of carrier liquid may then be removed with the removal unit 650. The removal unit 650 may thereto be porous, and could further comprise means for absorption or suction. Alternatively, the carrier liquid may be adhered to a surface of the rotational member of the removal unit 650, and therewith be removed. The adhered liquid film will again be removed from the rotational member. This can be done, in one suitable embodiment with a scraper device.

Rather than applying a positive or negative voltage to the removal unit 650, the unit could be coupled to ground, whereas an appropriate voltage is applied to the counter-member 690.

Rather than applying a voltage difference continuously, this could be done under the control of a control device, particularly for situations, in which a large volume of toner is transferred to the substrate 199 and a large volume of carrier liquid is to be removed. Such situations could for instance be the situations wherein the number of colours (applied from different imaging stages) exceeds a predefined number. Furthermore, such situations could involve situations wherein the pattern results in transfer of a high amount of liquid toner to the substrate; this is the case wherein the pattern is 'rather full' instead of being 'predominantly empty'. Photos typically contain a rather full pattern, whereas the printing of letterhead on paper is an example of a rather empty pattern.

In a further implementation, the liquid toner dispersion is subjected to a further charging treatment after its transfer to the substrate 199 and before removal of carrier liquid in the liquid removal unit 650. The charging treatment is for instance applied by means of a charging unit (not shown), and is for instance a corona treatment. Such a treatment ensures that the charged toner particles are pushed or drawn to the substrate 199.

Figure 2:
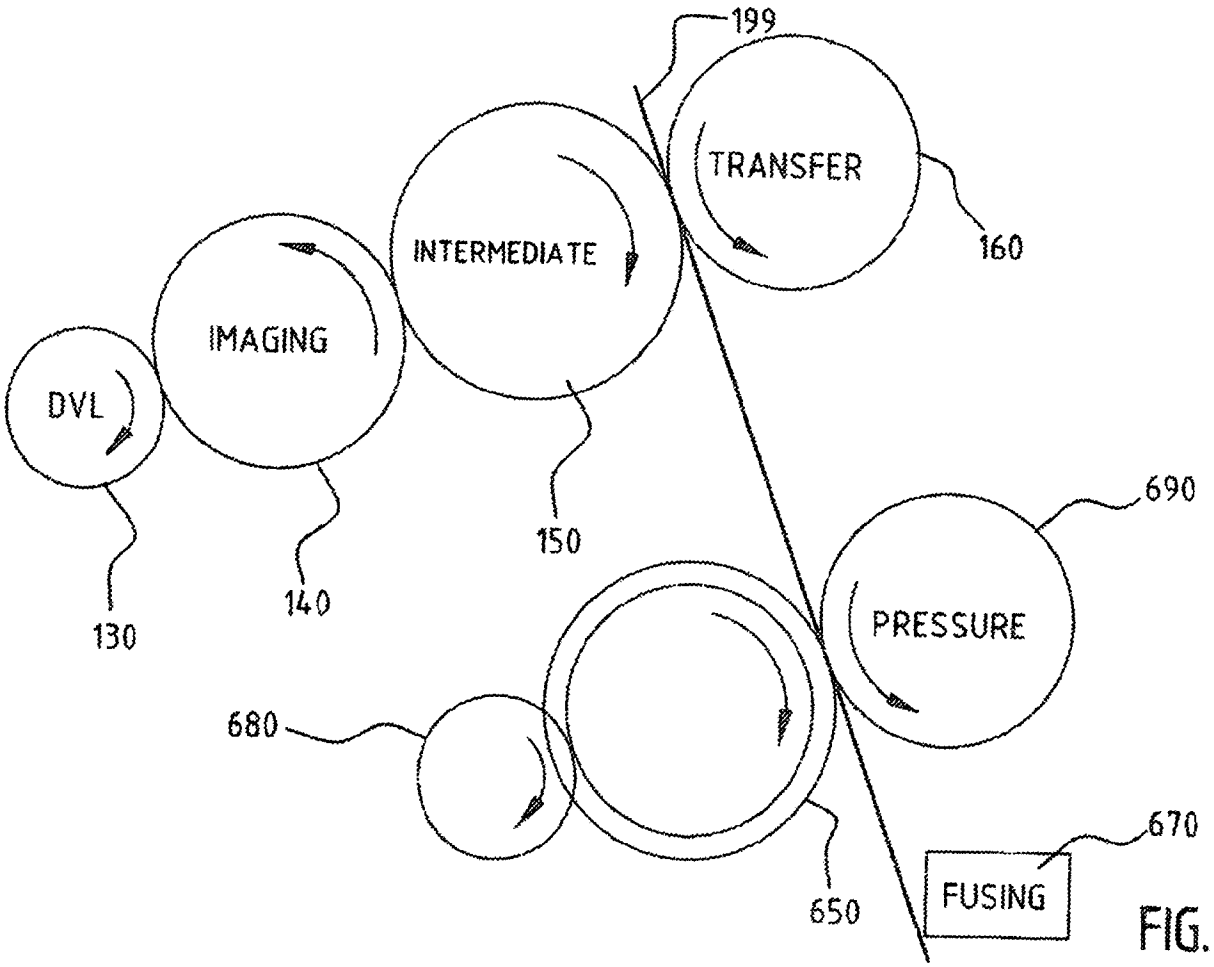
FIG. 2 is a schematic view illustrating a second embodiment of the invention.

FIG. 2 illustrates an embodiment of a digital printing apparatus according to a second aspect of the invention. The apparatus comprises an imaging member 140 adapted to sustain a pattern of electric charge forming a latent image on its surface; a development member 130 arranged to receive a quantity of liquid toner, and to develop said latent image by transferring a portion of said quantity of liquid toner onto said imaging member 140 in accordance with said pattern. The apparatus further comprises an optional intermediate member 150 and a transfer member 160 arranged for transferring a portion of the liquid toner from the imaging member 140 to a substrate 199. Downstream of the intermediate roller 150, there is provided a carrier liquid removal unit arranged for operating on the portion of the liquid toner transferred from the imaging member to a substrate. In the illustrated embodiment the carrier liquid removal unit comprises a sponge member 650 and a pressure member 690, respectively, which are arranged for rotating at either side of the substrate 199. The sponge member 650 is arranged to face the side carrying the portion of liquid toner. The sponge member 650 has an outer layer adapted to absorb carrier liquid, such that said sponge member 650 absorbs carrier liquid whilst rotating over the portion of liquid toner. The carrier liquid may be removed from the sponge member 650 by a removal roller 680.

In alternative embodiments the sponge member 650 and removal roller 680 may be replaced by a member as described above in connection with FIG. 3. According to yet another embodiment the carrier liquid may be sucked away from the substrate 199, e.g. using a carrier liquid removal unit with suction means adapted to collect a large part of the carrier liquid. In such embodiments the fused imaging particles should adhere well to the substrate 199 such that it is avoided as much as possible that imaging particles are removed together with the carrier liquid.

The apparatuses shown in FIG. 1 and FIG. 2 comprise a fusing unit 670. This fusing unit 670 may take any suitable form as described hereinafter. The fusing unit 670 may be arranged downstream of the carrier liquid removal unit formed by rollers 650, 690, and 680, such that the carrier liquid is removed before fusing. The fusing member 660 is configured to fuse imaging particles of a transferred part of the portion of liquid toner, by heating said transferred part on the substrate 199. Alternatively, there may be provided an image fusing unit using non-contact methods such as IR, UV and EB curing or other known methods of image fusing. Optionally also cooling means can be present downstream the TA area.

Figure 3:
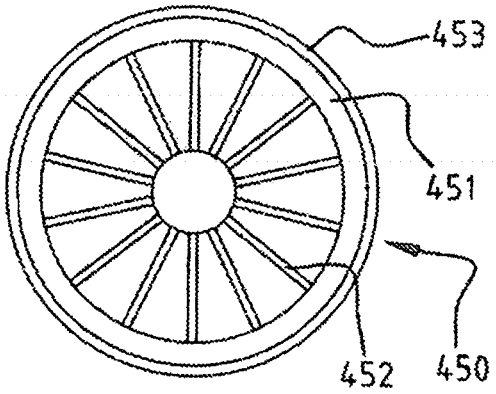
Figure 4:
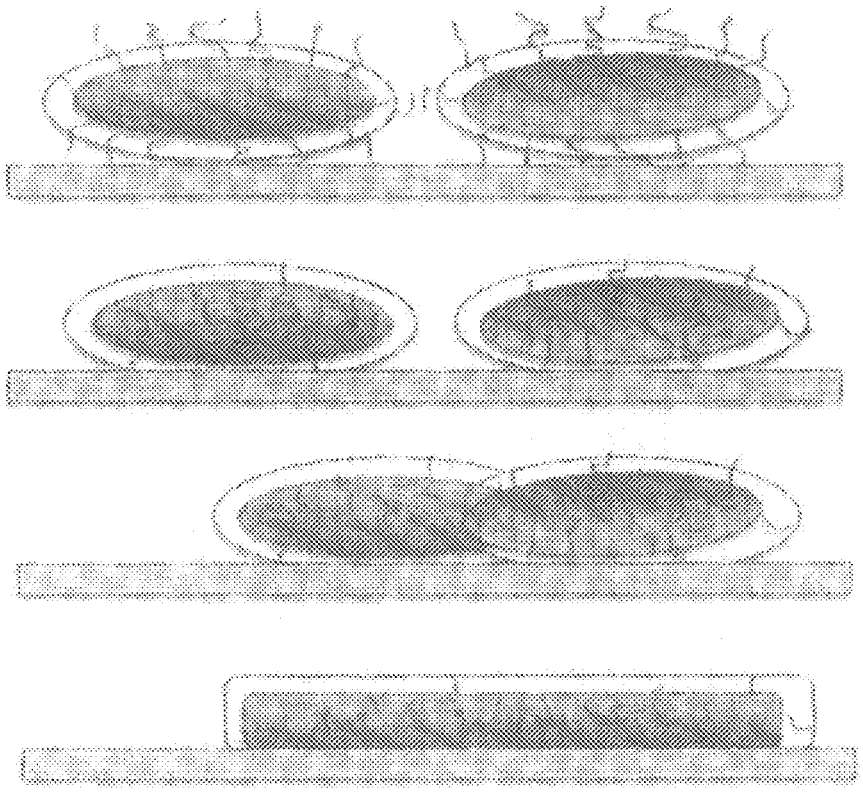
FIG. 4 is a diagrammatical illustration of the film formation process in accordance with the invention

FIG. 3 illustrates schematically a further embodiment of a transfer member of the invention. In this embodiment the transfer roller 450 is provided with an outer layer 451 carrying a semi-permeable membrane 453 configured for allowing carrier liquid to permeate in the outer layer 451, whilst not being permeable for marking particles present in the carrier liquid. The outer layer 451 is configured for collecting the carrier liquid, and the carrier liquid may be sucked out of the outer layer 451 through suction channels 452. Instead of using a semi-permeable membrane, the outer layer 451 may be made of a suitable absorption material adapted for absorbing carrier liquid whilst keeping toner particles at the outer surface as discussed for the first and second above.

The carrier liquid of this application is particularly a substantially non-polar carrier liquid. The term 'substantially non-polar' refers in the context of the present invention to a chemical entity that is overall non-polar even though it may contain some polarisable groups such as ester, hydroxyl group, and/or carboxyl group. The substantially non-polar carrier liquid is suitably selected from the group consisting of a mineral oil, a low or high viscosity liquid. Specific examples include silicone fluids, mineral oils, low viscosity or high viscosity liquid paraffin, isoparaffinic hydrocarbons, fatty acid triglycerides, fatty acid esters, vegetable oils or any combinations thereof. The carrier liquid may further contain variable amounts of additives, such as charge control agent (CCA), wax and plasticizers. Typical commercially available carrier liquids are Isopar L, Isopar M and Isopar V and higher boiling point Isopars from Exxon, white mineral oils from Sonneborn Inc., Paraffin oils of Petro Canada and vegetable oils from Cargill or oils derived from vegetable sources by chemical means.

In the context of the present invention, the liquid toner is a dispersion of toner particles in a carrier liquid. The toner particles, according to this invention, comprise coloured particles (also called ink particles or pigment) and a binder resin although non pigmented resin systems also can be used containing a phosphor or taggant or UV active material. Typically, the diameter of the toner particles is about 0.5 to 4.0 μm. More preferably, the average diameter of the toner particles is smaller than 2 μm, for instance in the range of 1.5 to 2.0 μm. The toner particles suitably have a concentration of about 40-95% of binder resin. The binder resin is a polymer, preferably transparent, that embeds the ink particles. Preferably, a polyester resin is used as binder resin. Also other types of resin having a very low or no compatibility with the carrier liquid and dispersing agent can be used. Preferably, the resin has a high transparency, provides good colour developing properties and has a high fixing property on the substrate. Most preferably, the shape of the toner particles is ellipsoid, which is beneficial for the fusing process.

The liquid toner is particularly used in a concentration with an appropriate solid content. The removal of carrier liquid from the substrate may be an additional removal, in addition to carrier liquid removals at the imaging member. Generally, the starting concentration of carrier liquid may herein be reduced, so as to avoid caking issues. Caking is the issue that liquid toner residue remaining for instance on the development member in the patterned transfer step, forms lumps in the dispersion resulting in a liquid with a non-uniform distribution of toner particles. This often results in an increase of the viscosity of the liquid dispersion and partial jelly fractions of ink. This viscosity increase is significant and could be a tenfold increase or even more. The removal of the liquid toner residue starts then to be problematic. As a result, liquid toner residue could remain on the development roller, which constitutes a contamination and may lead to a non-uniform distribution of fresh toner dispersion resulting in an image quality that is not perfect, in other words incorrect. Examples of issues are density instability and incorrect reproduction of fine lines.

A typical solid content of liquid toner dispersion during printing is a solid content of between 10 to 30 wt %, such as a solid content of 25 wt %. The solid content of the concentrated toner before dilution can go up to 50 or 60% According to this invention, "solid content" means the amount of toner particles in wt % with regard to the total liquid toner dispersion.

The term 'dispersing agent of the hyper-dispersant type' refers to a dispersing agent provided with anchor groups to which stabilising groups are coupled. Suitably examples of anchor groups of the dispersing agent are amine-functionalized polymers, such as polyalkyleneimines, for instance polyethyleneimine (PEI) and polyallylamines. The stabilizing groups of the dispersing agent are suitably chosen from the groups of fatty acid compounds and polyolefins, but similar groups are not excluded. The fatty acid compounds are for instance hydroxylated, and may be polymerized. A suitable degree of polymerization is for instance 1 (monomer) to 7, preferably 2 to 4. The amine functionality of this backbone can be partly or completely converted to amides or quaternized.

Preferred examples of the stabilizing groups and the dispersing agent in its entirety have been described in Applicants' non-prepublished patent applications NL2011955 and NL2012086, which are herein included by reference. Alternatively, use may be made of commercially available dispersing agent, such as Solsperse™ 13940, Solsperse™ 11000, which again combine a polyamine anchor group with polymeric stabilizing groups.

In a further embodiment, use can be made of a decomposable dispersing agent, such as described in the non-prepublished patent application NL2011064 in the name of Applicant, which is herein included by reference. Such a decomposable dispersing agent preferably comprises an anchoring group, a stimulus responsive part and a stabilizing part. The stimulus responsive part is herein suitably a photolabile group, that is suitably stimulated under irradiation with UV or infrared radiation. A suitable example is a diazene group or a benzoyl group. The latter is deemed suitable so that a rearrangement within the stimulus responsive part occurs. Such rearrangement involves for instance formation of a cyclic structure. Electron-donating groups may be present to simplify or enable formation of such cyclic structure. Moreover, the benzoyl (i.e. Ph-(C═O)—) group may be substituted on the phenyl-side (for instance with the anchoring part) and on the carbonyl-side (for instance with a stabilizing part). More specific examples of suitable photolabile groups are ortho-nitrobenzyl derivatives, a derivative of bis(2-nitrophenyl)methyl formate, a derivative of (E)-di(propan-2-yl)diazene, a benzoine derivative. More specific examples can be found in the above mentioned application NL2011064. The anchoring part is for instance an acrylate- or amine-functionalized polymer, having a plurality of binding sites (i.e. amine or acrylate groups) for binding to a substrate, more particularly the toner particle. Suitably use is made of aliphatic amines, such as linear amines, for instance polyallylamines and poly (alkylene)imines, wherein the alkylene preferably is chosen from $C_2$-$C_4$-alkylene. One suitable example is a polyethylene-imine. The stabilizing part is a more particularly a hydroxylated fatty acid compound (or polymer), but alternatively or additionally a polyolefine.

The term 'spacer agent' relates to an agent that is different from a dispersing agent and which spacer agent enables that the toner particles are kept at a minimum distance. Use is for instance made of hydrophobic colloidal particles, such as hydrophobic silica particles, aluminium oxide particles, titanium oxide particles or mixtures thereof. Such colloidal particles suitably have a particle size between 5 and 200 nm, more preferably between 30 and 100 nm and are for instance used in a concentration of 0.8-28 wt %, more preferably 2-12 wt % with respect to the weight of the toner particles.

Alternatively, use may be made of spacer agents that primarily comprise stabilizing moieties, such as used in the dispersing agent, however without any anchoring group. The stabilizing moieties of the spacer agent can therefore interact with the stabilizing and anchoring moieties of the dispersing agent. It is believed by the inventors that this interaction results in creating less attraction between the toner particles by elongation of the existing tails (stabilizing groups) of the dispersing agent ('DA-tails'), by creating inter-tail distortion by other conformational structures or by increasing the number of DA-tails without influencing the charging and/or fusing. This spacer agent typically comprises a polar head group which is essentially a single functional group (single site). Suitable examples of polar head groups are acids, such as carboxylic acid, sulphonic acids, anhydrides, such as succinic anhydride and amides and imide groups. The term 'tail' is used in the context of the present invention as a molecular part that is long on a molecular level and wherein the chemical function is primarily derived from its extension rather than the presence of specific functional groups. The tail of the spacer agent is preferably a polymer comprising a plurality of repetitive units with a weight-average molecular weight of less than 5000 g/mol, preferably in the range of 800-4000 g/mol. Suitably, the tail is based on a monomer compound comprising a carbon chain with at least one side chain. The monomer compound may contain an alkyl or alkylene group and optionally a carboxylic linking group. The carboxylic linking group is suitably an ester group. The alkyl- and alkylene chains are for instance prepared by combining saturated or unsaturated fatty acid, for instance C8-C26 fatty acids. Good results have been obtained with C16-C20 fatty acids, such as poly(hydroxy stearic acid) and poly(hydroxyricinoleic acid). More preferably, such polymers have a weight-average molecular weight in the range of 1200-3600 g/mol. Alternatively, use can be made of olefin, suitably based on a branched repetitive unit, such as isobutylene. The resulting polyolefin suitably has an average molecular weight in the range of 800-251800 g/mol.

FIG. 4A-D shows diagrammatically four stages in the transformation process occurring on the substrate. The Figures show effectively two ellipsoid toner particles with dispersing agent having stabilizing parts in the forms of tails or hairs. A minor layer of carrier liquid is shown around the toner particles. This layer is believed to remain there because of the presence of the dispersing agents molecules adsorbed on the surface. It is observed that this amount may well be larger.

In step 4A, the initial situation after transfer is shown. Separate toner particles are each encapsulated in a layer of carrier liquid.

In step 4B, the situation is shown upon infrared irradiation, wherein carrier liquid from the surface of the toner particles is started to be released due to the dispersing agents that are dissolving into the toner particle. Such dissolution is understood to occur, because the toner particle is heated to above the glass transition temperature of the toner resin.

In step 4C, the stage is shown of coalescence of the toner. Herein, the stability resulting from the dispersing agent is removed and the carrier liquid arrives in a state in which it can be removed when the film formation is completed. The toner particles start to merge, which process is understood to be surface energy driven.

Step 4D shows the result: the individual particles have been replaced by a film.

Thus, in summary, the invention relates to a digital printing apparatus using a liquid toner comprising toner particles in a carrier liquid for printing an image on a substrate. It comprises an imaging member 140 adapted to sustain a pattern of electric charge forming a latent image on its surface; a development member 130 arranged to receive a quantity of the liquid toner dispersion and to develop said latent image; means for transfer 150, 160 of the liquid toner dispersion from the imaging member 140 to the substrate 199 at a transfer location, and a fusing unit 670. The apparatus further comprises means for non-contact coalescence and a liquid removal unit 650 arranged for removal of carrier liquid from the substrate 199, and upstream of said fusing unit 670.

Herewith, it is achieved that coalescence occurs in an efficient way and suitably at high speed. In fact, it is beneficial to remove as much carrier liquid as possible before the temperature increase is applied. Additionally it is also beneficial to remove carrier liquid after the coalescence has taken place in a non-contact way. This should be done before the contact fusing takes place. Herewith ghost fusing can be avoided, and a good adhesion to the substrate results after contact fusing. Moreover, the risk of forming an emulsion is reduced significantly. The inventors have understood that ghost fusing occurs where gloss difference are introduced due to the presence of too much carrier liquid at locations where toner depositions have been made onto the substrate. This carrier liquid prevents the good transfer of heat resulting in the above mentioned ghost fusing image defects.

The invention claimed is:

1. A digital printing apparatus using a liquid toner comprising toner particles in a carrier liquid for printing an image on a substrate, wherein the substrate moves at a printer speed through the printing apparatus, which liquid toner further comprises a dispersing agent for stabilizing the toner particles in the carrier liquid, which toner particles comprise pigment and a binder resin, which apparatus comprises a plurality of imaging stages, each imaging stage comprising:

an imaging member adapted to sustain a pattern of electric charge forming a latent image on its surface;

a development member arranged to receive a quantity of the liquid toner dispersion and to develop said latent image by transferring a portion of said quantity of liquid toner onto said imaging member in accordance with said pattern, and means for transfer of the liquid toner dispersion from the imaging member to the substrate at a transfer location, wherein the apparatus further comprises a contact fusing unit for fusing of the liquid toner dispersion into the image on the substrate by means of heated rollers, a film formation unit arranged for operating on the portion of the liquid toner transferred from the imaging member to the substrate and comprising means for non-contact coalescence in the form of a source of infrared irradiation, said film formation unit being configured to transform said toner particles of the liquid toner into a film and to liberate carrier liquid, and wherein said contact fusing unit is arranged downstream of the film formation unit, and a carrier liquid removal unit that is arranged downstream of the film formation unit and upstream of the contact fusing unit, which carrier liquid removal unit is configured to remove carrier liquid from said film of liquid toner on the substrate without significant evaporation of carrier liquid, wherein the carrier liquid removal unit is embodied as a removal member that is in use in rotational contact with at least an outer layer of the liquid toner film.

2. The digital printing apparatus as claimed in claim 1, wherein the carrier liquid removal unit comprises a sponge member and a pressure member respectively arranged for rotating at either side of the substrate.

3. The digital printing apparatus as claimed in claim 1, wherein the source of infrared irradiation comprises a source for infrared irradiation with a spectrum primarily in the range of 800-2000 nm.

4. The digital printing apparatus as claimed in claim 1, wherein the removal member is a roller.

5. The digital printing apparatus as claimed in claim 4, further comprising means for removal of the carrier liquid from a surface of the roller.

6. The digital printing apparatus as claimed in claim 1, further comprising a second carrier liquid removal unit arranged upstream of the film formation unit.

7. The digital printing apparatus as claimed in claim 6, wherein the second liquid removal unit is configured for applying an electric field so as to attract charged toner particles in the liquid dispersion to a surface of the substrate.

8. The digital printing apparatus as claimed in claim 7, wherein the application of the electric field is controlled so as to achieve layer splitting of the liquid toner dispersion between a first layer rich in toner particles adjacent to the substrate surface and an outer layer primarily consisting of carrier liquid.

9. The digital printing apparatus as claimed in claim 6, wherein the removal unit comprises an electrical conductor onto which a voltage can be applied, which voltage is controlled so as to repulse the charged toner particles towards the substrate surface.

10. A digital printing process using liquid toner, said liquid toner comprising toner particles and a carrier liquid, and a dispersing agent for stabilizing the toner particles in the carrier liquid, which toner particles comprise pigment and a binder resin, said process comprising creating a plurality of developed images on a substrate, which moves through a printing apparatus embodying said process at a printer speed, each creation step comprising:

producing a latent image as a pattern of electric charge on an imaging member;

transferring a quantity of liquid toner onto a development member;

developing said latent image by transferring a portion of said quantity of liquid toner onto said imaging member in accordance with said pattern, and;

wherein said process further comprises:

transferring a developed portion of liquid toner to the substrate;

fusing said developed portion of liquid toner by means of contact fusing using heated rollers, film formation of the liquid toner prior to the fusing, which film formation comprises the step of non-contact coalescence by irradiation with infrared radiation, wherein carrier liquid is liberated and removing carrier liquid of said transferred developed portion without significant evaporation of carrier liquid, wherein a removal member is used that is in rotational contact with at least an outer layer of the liquid toner dispersion, wherein the non-contact coalescence occurs prior to the removal of carrier liquid.

11. The digital printing process as claimed in claim 10, wherein the film formation comprises dissolving dispersing agent into the binder resin.

12. The process as claimed in claim 10, wherein at least a portion of the toner particles are ellipsoid in shape.

13. The process as claimed in claim 10, wherein the average particle size of the toner particles is smaller than 2.5 μm.

14. The process as claimed in claim 13, wherein the average particle size of the toner particles is in the range of 1.5-2.0 μm.

15. The process of claim 10, wherein the substrate is moved through an apparatus embodying the said process steps with a linear speed of at least 0.5 m/s.

16. The process of claim 10, wherein the removal of carrier liquid comprises splitting the liquid toner into a first layer adjacent to a surface of the substrate, and a second, outer layer, and removing carrier liquid from the second, outer layer.

17. The process of claim 10, wherein the removal of carrier liquid occurs by applying a voltage difference over the liquid toner.

18. The process of claim 10, wherein the dispersing agent of the hyper-dispersant type comprising an anchor group for binding to a toner particle and stabilizing groups coupled to said anchor group for stabilizing said toner particle in the carrier liquid.

19. A digital printing apparatus using a liquid toner comprising toner particles in a carrier liquid for printing an image on a substrate, which liquid toner further comprises a dispersing agent for stabilizing the toner particles in the carrier liquid, which toner particles comprise pigment and a binder resin, which apparatus comprises a plurality of imaging stages, each imaging stage comprising:

an imaging member adapted to sustain a pattern of electric charge forming a latent image on its surface;

a development member arranged to receive a quantity of the liquid toner dispersion and to develop said latent image by transferring a portion of said quantity of liquid toner onto said imaging member in accordance with said pattern, and means for transfer of the liquid toner dispersion from the imaging member to the substrate at a transfer location, wherein the apparatus further comprises:

a contact fusing unit for fusing of the liquid toner dispersion into the image on the substrate by means of heated rollers, a film formation unit arranged for operating on the portion of the liquid toner transferred from the imaging member to the substrate and comprising means for non-contact coalescence, said film formation unit being configured to transform said toner particles of the liquid toner into a film and to liberate carrier liquid, and wherein said contact fusing unit is arranged downstream of the film formation unit, and a carrier liquid removal unit that is arranged downstream of the film formation unit and upstream of the contact fusing unit, which carrier liquid removal unit is configured to remove carrier liquid from said film of liquid toner on the substrate without significant evaporation of carrier liquid, wherein the carrier liquid removal unit is embodied as a removal member that is in use in rotational contact with at least an outer layer of the liquid toner film.

* * * * *